US005138951A

United States Patent [19]

Berville et al.

[11] Patent Number: 5,138,951

[45] Date of Patent: Aug. 18, 1992

[54] DEVICE FOR STOPPING ROTATION BETWEEN A BAR AND A SABOT

[75] Inventors: Marc Berville, Luty sur Arnon; Joël Leblond, Bourges, both of France

[73] Assignee: Giat Industries, Versailles, France

[21] Appl. No.: 744,347

[22] Filed: Aug. 12, 1991

[30] Foreign Application Priority Data

Aug. 13, 1990 [FR] France ..... 90 10287

[51] Int. Cl.[5] ..... F42B 14/06

[52] U.S. Cl. ..... 102/521; 102/703

[58] Field of Search ..... 102/520-527, 102/703

[56] References Cited

U.S. PATENT DOCUMENTS

| | | | |
|---|---|---|---|
| 3,695,181 | 10/1972 | Bull et al. | 102/93 |
| 3,981,246 | 9/1976 | Luther | 102/521 |
| 4,733,612 | 3/1988 | Sigg | 102/521 |
| 4,735,148 | 4/1988 | Holtzman et al. . | |
| 4,802,415 | 2/1989 | Clarke . | |

FOREIGN PATENT DOCUMENTS

| | | |
|---|---|---|
| 255570 | 2/1988 | European Pat. Off. . |
| 2007822 | 9/1970 | Fed. Rep. of Germany . |
| 2227656 | 1/1973 | Fed. Rep. of Germany . |
| 2087797 | 12/1971 | France . |
| 1286587 | 8/1972 | United Kingdom . |

*Primary Examiner*—Harold J. Tudor

*Attorney, Agent, or Firm*—Bell, Seltzer, Park & Gibson

[57] ABSTRACT

The technical sector of the invention is that of devices for stopping rotation between a rifled bar and a sabot of an arrow-type projectile.

The device according to the invention is characterized in that it comprises at least one obstacle (6) disposed in a housing (7) made radially in the sabot (1), immobilized in translation in its housing by a locking means and one end (8) of which comes into contact with the bar (2) at the level of a bearing surface arranged at a distance from the axis (4) of the bar which is at least equal to the maximum diameter of the rifling of the bar.

Application to large-caliber arrow-type munitions.

6 Claims, 4 Drawing Sheets

DEVICE FOR STOPPING ROTATION BETWEEN A BAR AND A SABOT

The field of the present invention is that of devices for stopping rotation between a rifled bar and a sabot of an arrow-type projectile.

An arrow-type projectile is composed in a known manner from a sub-calibre bar which is integral with a full-calibre sabot.

The sabot consists of several segments (generally three) which separate and release the bar at the muzzle of the barrel of the weapon under the action of aerodynamic forces.

It is necessary to control the relative position of the bar and of the sabot of an arrow-type projectile to within one millimeter.

In fact, this positioning determines the lengths of the parts of the bar which extend to the front and to the rear of the sabot, these lengths having to be complied with so that the complete munition can meet the requirements for automatic loading.

Compliance with these lengths also influences the mechanical behaviour of the projectile during launching in a cannon.

In the past, efforts have been made to stop rotation in different ways:

Thus, making it adhere to the bar, use has been made of an elastomer seal which provides a seal between the segments of the sabot. The drawback of such an arrangement is that it risks leaving elastomer residues on the bar, which may have an adverse effect on its trajectory.

As has been described in Patent FR 2,611,889, a rear washer has also been disposed simultaneously to wedge the round, radially support the projectile relative to the sleeve and rotationally link the sabot and the bar.

Such a solution is expensive and difficult to adapt to current high-performance arrow-type projectiles in which the bar is long and has to be driven by an equally long sabot (over 350 mm for 120 mm calibre).

In fact, such sabots have front and rear portions whose profile is substantially conical and whose reduced thickness cannot accommodate the locking means described in this patent.

Patent DE 2,007,822 describes a gyro-stabilised sub-calibre projectile which is made to rotate integrally with a sabot by means of radial pins. These pins engage in housings made in the rear portion of the projectile.

The driving sabot consists of a single piece, the pins are firstly released from the projectile under the effect of centrifugal forces and secondly released by the sabot itself, their housing in the projectile thus being in the shape of an open duct at the rear portion of the latter.

These solutions cannot be transferred to an arrow-type munition. In fact, this type of munition is not driven by a rotational movement sufficient to ensure ejection of the pins from their housing, and the length of the arrow-type bars is such that their rear portion carrying the fins is located well to the rear of the sabot and thus cannot receive a drive pin.

Patent EP 255,570 describes an arrow-type munition in which pins for rotational linking are disposed between a single-piece sabot and a non-rifled portion of the bar. This munition is fired in a rifled barrel and the linking pins are released by centrifugal forces actually inside the barrel so as to permit controlled rotation of the bar relative to the sabot.

Such a solution cannot be transferred to a large-calibre arrow-type munition in which substantially the entire length of the bar which is in contact with the sabot is rifled and in respect of which the speed of rotation is insufficient to ensure ejection of the pins.

Patent FR 2,087,797 describes a gyro-stabilised sub-calibre projectile comprising two sabots. The projectile is rotationally linked to the sabots by means of axial pins. In fact, it is difficult to achieve a rotational link by means of pins since all machining of the bar leads to it becoming brittle, which adversely affects the lethality of the bar on the target.

Moreover, an obstacle engaged in the bar body will be difficult to clear on release of the sabot. It may remain engaged in the bar and prejudice the ballistics of the latter, or, alternatively, it may even have an adverse effect on separation of the sabot and of the bar.

The invention aims to propose means for rotational linking between a bar and a sabot of an arrow-type projectile and, more particularly, of a large-calibre arrow-type projectile, which means do not adversely affect the mechanical behaviour of the bar and do not prejudice separation of the sabot and of the bar at the muzzle of the barrel of the weapon.

The invention also aims to propose means which are easy to install from an industrial point of view.

The subject of the invention is thus a device for stopping rotation between a rifled bar and a sabot of an arrow-type projectile, which device is characterised in that it comprises at least one obstacle, disposed in a housing made radially in the sabot, immobilised in translation in its housing by a locking means, and one end of which comes into contact with the bar at the level of a bearing surface located at a distance from the axis of the bar which is at least equal to the maximum diameter of the rifling of the bar.

The advantage of such an arrangement is that, in a simple manner, it provides the desired stopping of rotation without thereby creating an area where the bar is made brittle.

According to a first embodiment of the invention, the obstacle is a peg and the housing is a bore with an axis which is substantially perpendicular to the axis of the sabot, and the peg engages in a substantially cylindrical indentation made in the rifling of the bar.

In this case, the locking means may include force fitting of the peg in its bore.

According to a second embodiment, the obstacle is a longitudinal key which comes into contact with the bar at the level of a corresponding longitudinal indentation made in the rifling of the bar.

Preferably, an obstacle will be associated with at least three housings made on the sabot and with at least four indentations made on the bar.

This thus facilitates manufacture of the projectiles while enabling obstacles to be positioned without preliminary position setting.

According to a third embodiment of the invention, the bore opens out at the level of the top of a tooth of the rifling of the sabot and has a diameter less than the width of this tooth top, and the peg may then be made from a malleable material chosen such that it yields and becomes encrusted between the riflings of the bar and of the sabot on either side of the bore during positioning of the peg, thus constituting the locking means.

The malleable material may be chosen from the following materials: annealed copper, medium-hard iron, polyamide, lead, tin.

According to one embodiment, the housing may be arranged at the level of a plane of separation between two elements of the sabot and substantially symmetrically relative to this plane.

Thus the obstacle does not prejudice separation of the sabot and of the bar at the muzzle of the barrel of the weapon.

The invention will be better understood on reading the description of particular embodiments, which description is made with reference to the appended drawings, in which.

Figure 1:
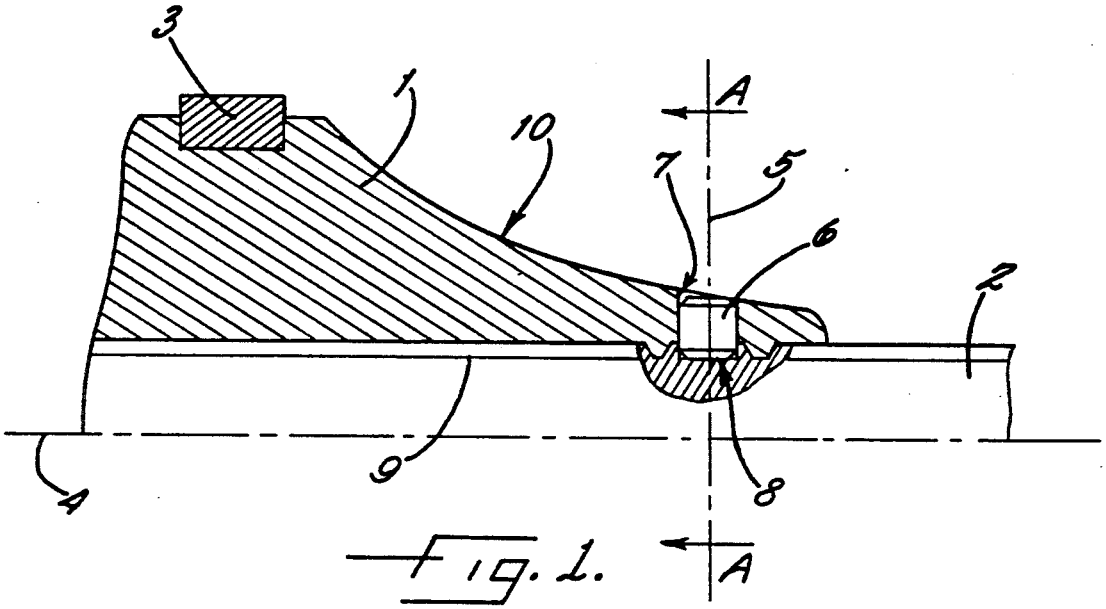
FIG. 1 is a partial diagrammatic view in longitudinal section of an arrow-type projectile carrying a first embodiment of the stopping device according to the invention.
Figure 2:
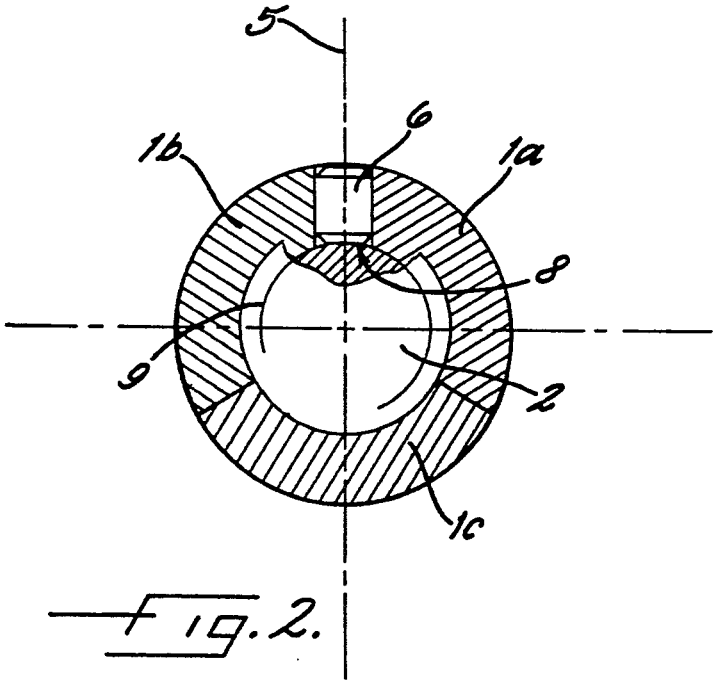
FIG. 2 is a cross-section through the plane AA in FIG. 1.

Referring to FIGS. 1 and 2, an arrow-type projectile comprises a sabot 1, consisting of three segments 1*a*, 1*b*, 1*c*, and a bar 2.

The sabot 1 carries, arranged in a groove, a band 3 which is intended, on firing, to provide a seal between the projectile and the barrel of the weapon (not shown).

The sabot drives the bar by means of rifling which is shown diagrammatically in this case, the fine line representing the diameter at the bottom of the rifling 9 of the bar.

The sabot 1 carries at the level of its rear portion (or, if appropriate, at the level of its front portion) at least one housing, which, in this case, is a bore 7, whose axis 5 is substantially perpendicular to the axis 4 of the sabot and of the bar. An obstacle, which is, in this case, a substantially cylindrical peg 6, is arranged in this bore and comes into contact via one end 8 with the bar 2.

Figure 3:
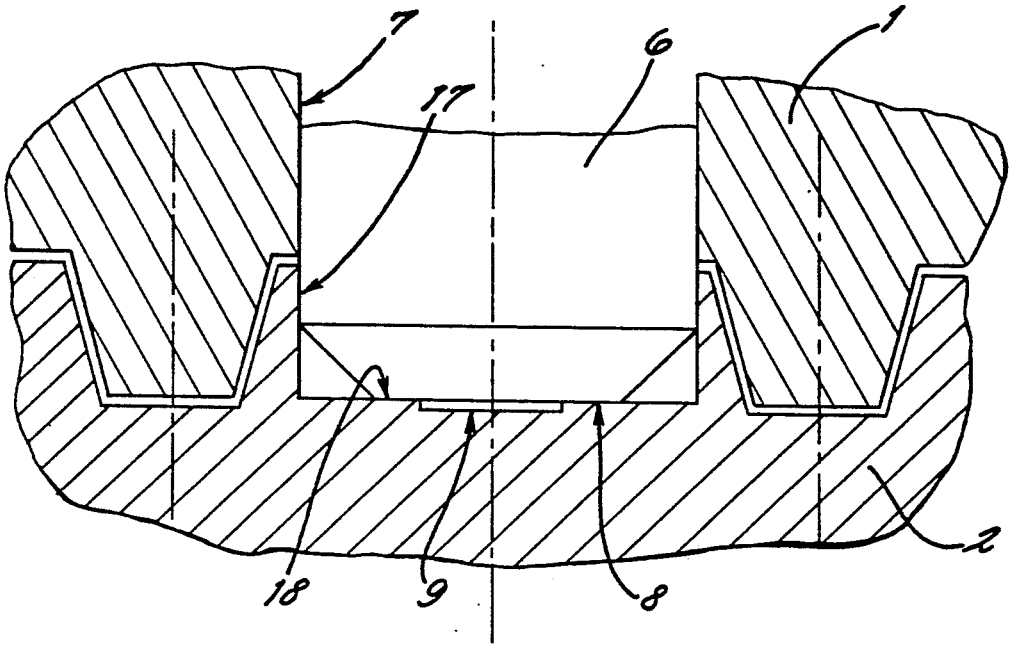
FIG. 3 is an enlarged view of a detail in FIG. 1.

As may be seen more clearly in FIG. 3, the bar 2 carries a cylindrical indentation 17 whose base forms a bearing surface 18 for the substantially plane end 8 of the peg 6.

The depth of the indentation is less than or equal to the depth of the rifling of the bar, thus the bearing surface 18 is located at a distance from the axis 4 of the bar which is greater than or equal to the diameter of the body of the bar, that is to say the maximum diameter of the rifling 9 of the bar.

Thus, the body of the bar is not cut, which ensures a mechanical behaviour on the target equivalent to that of a bar without an indentation.

Moreover, as penetration of the obstacle in the bar is reduced, separation of the sabot and of the bar is not prejudiced by the obstacle.

The peg is immobilised in its bore by a locking means which is, in this case, a relative force fitting (forcing of the order of a few microns).

It would also be possible to provide a slide fitting, it being possible for the locking means then to be an adhesive bonding point.

The peg will be made from aluminium or from a plastic material such as polyamide 6,6 and its diameter will be chosen so as to be slightly greater than the pitch of the rifling of the bar (for example by a few tenths), so that, regardless of the position of the bore 7, the peg 6 will certainly come into contact with the teeth of the rifling of the bar.

In the particular embodiment described and as may be seen in FIG. 2, the bore is made at the level of a plane of separation between two segments 1*a* and 1*b* of the sabot and substantially symmetrically relative to this plane, such an arrangement being favourable to satisfactory separation of the segments of the sabot.

From the point of view of manufacture, the bore will be drilled after mounting of the sabot on the bar and at the same time as the cylindrical indentation 17 is made, a small cylindrical milling cutter making it possible to obtain the substantially plane bearing surface 18.

After positioning of the peg in its housing, a rear seal (not shown in this case; see, for example, Patent EP 306,615 and the U.S. Registration Statutory Invention No. H265) will be arranged on the rear face 10 of the sabot and will close off the bore 7, providing a seal at this level.

Figure 4:
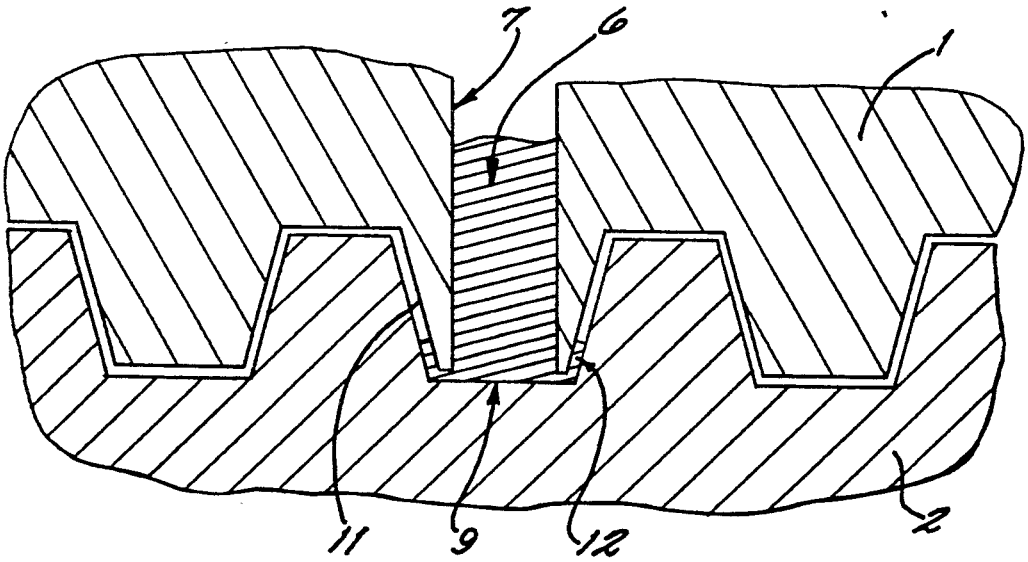
FIG. 4 is an enlarged view of a second embodiment of the stopping device according to the invention.

FIG. 4 shows a second embodiment of the invention in which the bore 7 is made before mounting the bar in the sabot and at a point such that it opens out at the level of the top of a tooth of the sabot.

The bore thus has a diameter which is substantially smaller than the core diameter of the top of the tooth of the sabot (of the order of 0.5 mm).

The peg inserted will be chosen to be of a malleable material which has mechanical properties such that, positioned with a force of the order of a few tenths of DaN, it yields and becomes encrusted between the riflings of the bar and of the sabot, on either side of the bore 7, in the functional play 11 which exists between the profile of the rifling of the bar 2 and that of the rifling of the sabot 1.

Materials such as annealed copper, medium-hard iron, polyamide, lead or tin are well suited to such a deformation.

The bead 12 thus produced, by becoming inserted in the play 11, will provide stopping of rotation of the bar and of the sabot, and will also form the means for locking the peg in its bore.

The bearing surface between the peg and the bar comprises, in this case, the bottom of the rifling 9 itself and a portion of the profile of the rifling.

The bore will preferably further be positioned at the level of the plane of separation between two segments of the sabot and substantially symmetrically relative to this plane.

Figure 5:
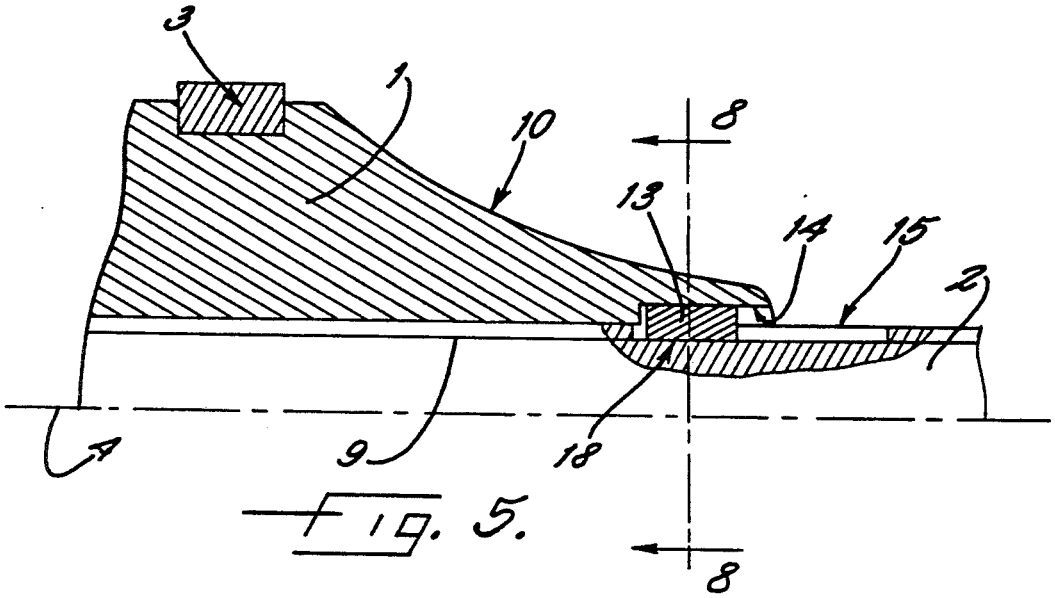
FIG. 5 is a partial diagrammatic view in longitudinal section of an arrow-type projectile carrying a third embodiment of the stopping device according to the invention.
Figure 6:
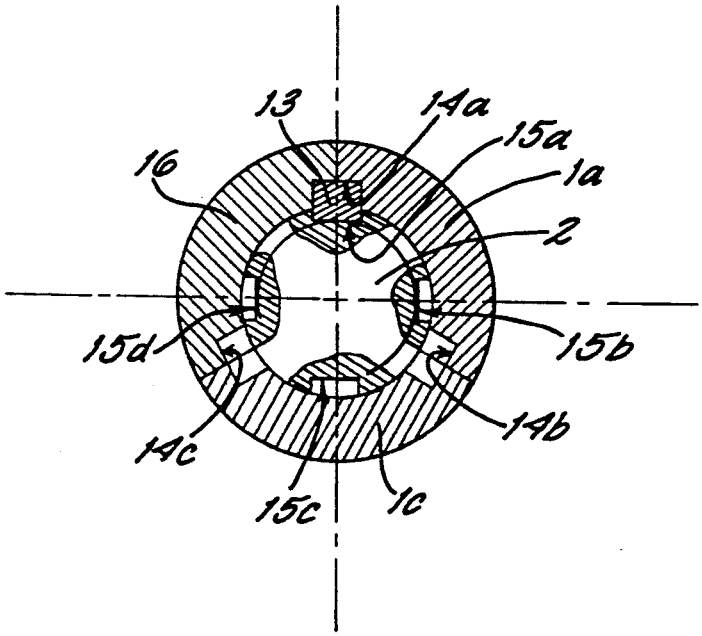
FIG. 6 is cross-section through the plane BB in FIG. 5.

FIGS. 5 and 6 show a third embodiment of the invention in which the obstacle is a key 13 arranged in a longitudinal housing 14 of the sabot.

The bar has a longitudinal indentation 15 for receiving this key, and the indentation has, as in the example of FIGS. 1 to 3, a depth which is smaller than or equal to the depth of the rifling of the bar.

Thus, the bearing surface 18 is arranged at a distance from the axis 4 of the bar which is at least equal to the maximum diameter of the rifling 9 of the bar, the indentation thus not penetrating into the actual body of the bar, which prevents an adverse effect on its mechanical behaviour and facilitates separation of the key and of the bar upon release of the bar by the sabot at the muzzle of the barrel of the weapon.

The key will be made from aluminium or a plastic material, for example polyamide 6,6.

The indentation 15 will have a length such that it is possible to position the key after mounting the bar in the sabot.

In order to facilitate mounting, a number of housings will be provided in the sabot which is different from the number of indentations made on the bar.

It will thus be easy to make a housing in the sabot coincide with an indentation of the bar while limiting the size of the angle of rotation needed to make these two elements coincide (and thus the uncertainty as to the relative final axial position of the bar and of the sabot).

By way of example, for 3 sabot housings and 4 bar indentations, an angular positioning accuracy of the sabot with respect to the bar of 1/24° pitch is obtained. With a rifling having a pitch equal to 4 mm, this gives a longitudinal positioning accuracy of the bar of 1/6° mm, such accuracy being compatible with the longitudinal positioning tolerances of the bar, which are usually of the order of 1 mm.

It is thus possible separately to manufacture the sabot and the bar bearing their respective housings and indentations without making any previous marking at all, final mounting making it possible to obtain both axial positioning and the desired angular positioning.

It is also possible to arrange the three housings on the sabot at the level of the planes of separation between the segments of the sabot and in a substantially symmetrical manner relative to these planes in order to prevent any interference on opening the sabot.

The rear seal will be arranged on the rear face 10 of the sabot and will close off the housings 14 and indentations 15 by forming a seal at this level.

Figure 7:
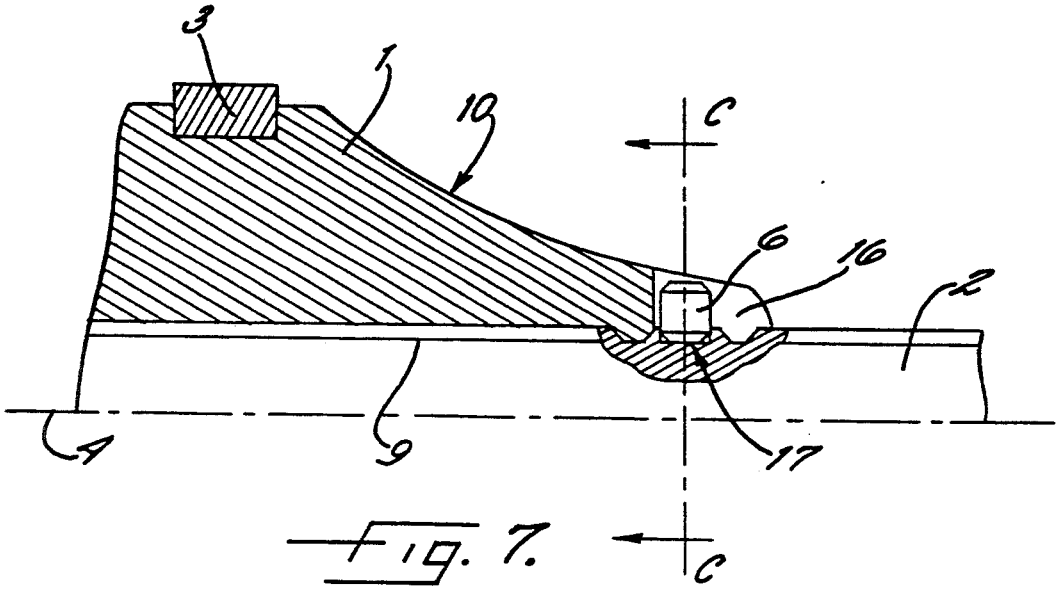
FIG. 7 is a partial diagrammatic view in longitudinal section of an arrow-type projectile carrying a fourth embodiment of the stopping device according to the invention.
Figure 8:
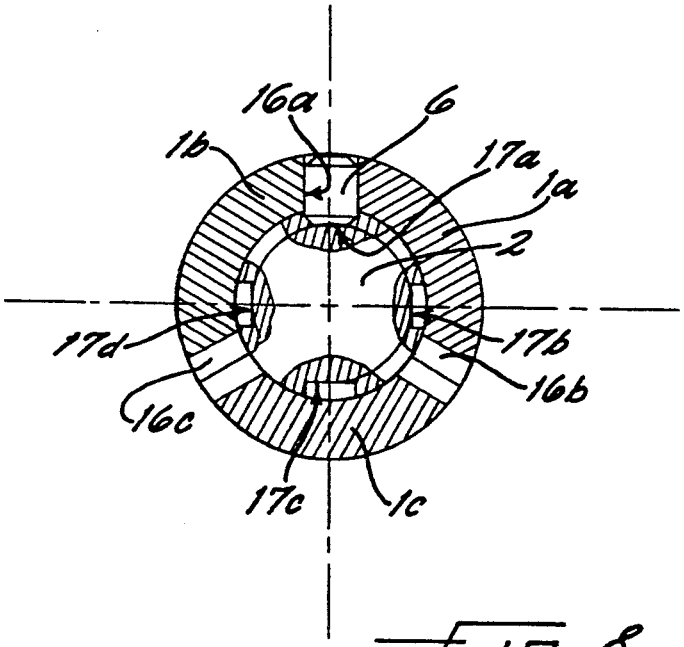
FIG. 8 is a cross-section through the plane CC in FIG. 1.

FIGS. 7 and 8 show a final embodiment in which the obstacle is a cylindrical peg 6 arranged in an opening-out channel 16 made on the sabot and engaging in a cylindrical indentation 17 made on the bar with the same conditions of depth as previously.

As in the preceding example, a number of channels are provided in the sabot which is different from the number of indentations made on the bar. In this case, three channels are provided on the sabot, arranged at the level of the planes of separation between the segments of the sabot and substantially symmetrically relative to these planes, and four indentations on the bar.

Machining operations are also carried out before mounting but, in this particular embodiment, the indentations are no longer visible when the bar is mounted, temporary marking of their position thus being necessary.

It would also be possible in this embodiment to replace the channels of the sabot by three bores.

In all cases, accuracy in the relative positioning obtained is the same as in the preceding example and a seal will also be arranged on the rear face 10 of the sabot, forming a seal at the level of the channels and of the indentations.

In all cases, the obstacle housings and indentations will, if appropriate, be arranged at the front portion of the sabot, it then being possible to deposit, after positioning the obstacles, an adhesive bonding spot at the level of the housings.

We claim:

1. In an arrow-type projectile comprising a rifled bar and a sabot, the combination therewith of a device for stopping rotation between the rifled bar and the sabot comprising at least one obstacle disposed in a housing made radially in said sabot, immobilized in translation in its housing by a locking means, with one end thereof coming into contact with the rifled bar at the level of a bearing surface formed by a bottom of an indentation made in the rifling of the bar, said bottom being located at the level of a bottom of the rifling of the bar.

2. Device according to claim 1, characterised in that the obstacle is a peg (6) and in that the housing is a bore (7) with an axis (5) which is substantially perpendicular to the axis (4) of the sabot.

3. Device according to claim 1, characterised in that locking means comprises a force fitting of the peg (6) in its bore (7).

4. Device according to claim 1, characterised in that the obstacle is a longitudinal key (13) and in that this key comes into contact with the bar (2) at the level of a corresponding longitudinal indentation (15) made in the rifling of the bar (2).

5. Device according to one of claims 3 to 5, characterised in that it combines an obstacle (6, 13) with at least three housings (14, 16) made on the sabot (1) and with at least four indentations (15, 17) made on the bar (2).

6. Device according to claim 1, characterized in that the sabot consists of at least two elements disposed on both sides of a separation plane, and in that the housing is arranged at the level of said plane of separation and substantially symmetrically relative to this plane.

* * * * *

UNITED STATES PATENT AND TRADEMARK OFFICE

CERTIFICATE OF CORRECTION

PATENT NO. : 5,138,951

DATED : August 18, 1992

INVENTOR(S) : Marc Berville et al.

It is certified that error appears in the above-identified patent and that said Letters Patent is hereby corrected as shown below:

Column 6, line 41, "3 to 5" should be -- 3 to 4 --.

Signed and Sealed this

Thirty-first Day of August, 1993

Bruce Lehman

*Attest:*

BRUCE LEHMAN

*Attesting Officer*

*Commissioner of Patents and Trademarks*